US005657865A

United States Patent [19]

Harrelson

[11] Patent Number: 5,657,865

[45] Date of Patent: Aug. 19, 1997

[54] REINFORCED BASKET-STYLE CARRIER

[75] Inventor: Glen Harrelson, Gainsville, Ga.

[73] Assignee: Riverwood International Corporation, Atlanta, Ga.

[21] Appl. No.: 570,457

[22] Filed: Dec. 11, 1995

[51] Int. Cl.[6] ..... B65D 75/00; B65D 65/00

[52] U.S. Cl. ..... 206/194; 206/162; 206/427

[58] Field of Search ..... 206/162, 170, 206/174, 175, 186, 193, 198, 167, 200, 180, 185, 194, 427

[56] References Cited

U.S. PATENT DOCUMENTS

| | | | |
|---|---|---|---|
| 2,551,559 | 5/1951 | Gilbert | 206/200 X |
| 5,499,712 | 3/1996 | Harrelson | 206/162 X |
| 5,518,110 | 5/1996 | Harrelson | 206/139 |
| 5,540,325 | 7/1996 | Harrelson | 206/162 |
| 5,547,074 | 8/1996 | Plaxico et al. | 206/193 |

FOREIGN PATENT DOCUMENTS

| | | | |
|---|---|---|---|
| 732475 | 4/1966 | Canada | 206/162 |

*Primary Examiner*—Bryon P. Gehman

[57] ABSTRACT

A basket-style carrier having reinforced corner areas and reinforced end panels. Bottom panel reinforcing flaps are connected to the end panels and to gusset panels which in turn are connected to a bottom panel flap. The gusset panels lie between the reinforcing flaps and the bottom panel. The end panels include cutouts from which end panel reinforcing flaps are formed. The end panel reinforcing flaps are adhered to the end panels adjacent the cutouts. Side panel cutouts have cover flaps foldably attached. When folded into the carrier, the cover flaps form bottle stabilizers and also cover the pricing code on packaged articles.

15 Claims, 4 Drawing Sheets

REINFORCED BASKET-STYLE CARRIER

FIELD OF THE INVENTION

This invention relates to a basket-style carrier for carrying articles such as beverage bottles. More particularly, it relates to a basket-style carrier which reinforced bottom and end panels.

BACKGROUND OF THE INVENTION

Basket-style carriers are commonly employed to package beverage bottles. They include a separate cell for each bottle, from which the bottles can be readily removed, and a center handle partition for carrying the package. The carriers are fabricated from a blank which is folded and glued into collapsed carrier form, after which the collapsed carrier is erected and the bottles inserted.

The bottom panels of basket-style carriers are conventionally formed from bottom panel flaps which are foldably connected to opposite side panels. The flaps are overlapped and attached to each other by glue or by mechanical locks. In order to additionally stabilize the bottom panel, forming tabs connected to the handle panel or to riser panels are glued to the bottom panel during the bottom panel forming operation. While stabilizing measures such as this are successful in strengthening the bottom panels of basket carriers, they add additional gluing steps at the point of bottom panel formation and can slow the forming process. It would be advantageous to be able to form a strong bottom panel without the need for forming tabs.

It has also been found desirable to provide cutouts or open areas in the side and end panels of basket-style carriers. Such openings may serve a dual purpose. They allow the lower portions of the bottles to be viewed while in the carrier, which is advantageous from a sales point of view, and they permit the carriers to be shipped to retail sites in molded packing trays. Packing trays conventionally have been of rectangular shape designed to hold four basket carriers, with the smooth inner faces of the packing tray walls being dimensioned to allow the carriers to tightly fit after being dropped into place. More recent designs of packing trays formed of molded plastic make use of reinforcing struts which extend from the tray walls diagonally down to the tray bottom. This effectively reduces the interior packing space if the outer dimensions of the trays remain the same as the dimensions of trays of the older design. The problem is solved by open areas in the carriers which are designed to receive the reinforcing struts without encountering interference from the bottles or the carrier structure. Cutouts in the corner areas of the carriers serve similar purposes. They allow additional portions of the packaged bottles to be on view and permit the carriers to accommodate the corner posts of molded packing trays.

The presence of corner cutout areas and nearby open areas in the side and end panels can reduce the strength of the corner areas of basket-style carriers. It is therefore an object of the invention to provide a basket carrier which has strong corner areas despite the existence of cutouts. Another object is to provide a strong bottom panel which does not require the use of forming tabs. A further object is to provide a basket carrier which is physically able to withstand the stress of being dropped into place in a packing tray despite the presence of large cutout areas in the side and end panels.

BRIEF SUMMARY OF THE INVENTION

The invention is incorporated in a basket-style article carrier for carrying two rows of articles comprised of opposite side panels connected to a bottom panel, opposite end panels connected to the side panels and a handle panel located between the side panels. The bottom panel is comprised of two interconnected bottom panel flaps, each flap being foldably connected to one of the side panels. A bottom panel reinforcing flap is foldably connected to each of the end panel sections and a gusset panel is foldably connected to each of the bottom panel reinforcing flaps. Each gusset panel is also foldably connected to an associated bottom panel flap and lies between an associated bottom panel flap and an associated reinforcing flap. This arrangement reinforces the bottom panel in the corner areas with a three-ply construction, which is especially useful when the side and end panels contain cutouts.

In addition, end panels containing cutouts may be reinforced by means of an end panel reinforcing flap foldably connected to the side edges of the cutouts. The end panel reinforcing flaps are adhered to the inner surface of the associated end panel.

The side panel cutouts may be provided with a flap which is foldably connected to the upper edge of the cutout. The side panel cutout flap has a triangular section adjacent the fold line which, upon the flap being folded up into the interior of the carrier, fits between portions of adjacent curved articles packaged in the carrier. This reduces article contact within the carrier. When folded into the interior of a carrier the flaps cover the pricing code on the articles, thereby preventing erroneous price scanning of the carrier.

The carrier is structurally sound and economical to produce. In addition, it meets the desired objectives stated above. These features and aspects of the invention referred to above, and others as well, will be readily ascertained from the detailed description of the preferred embodiments described below.

DETAILED DESCRIPTION OF THE PREFERRED EMBODIMENT

Figure 1:
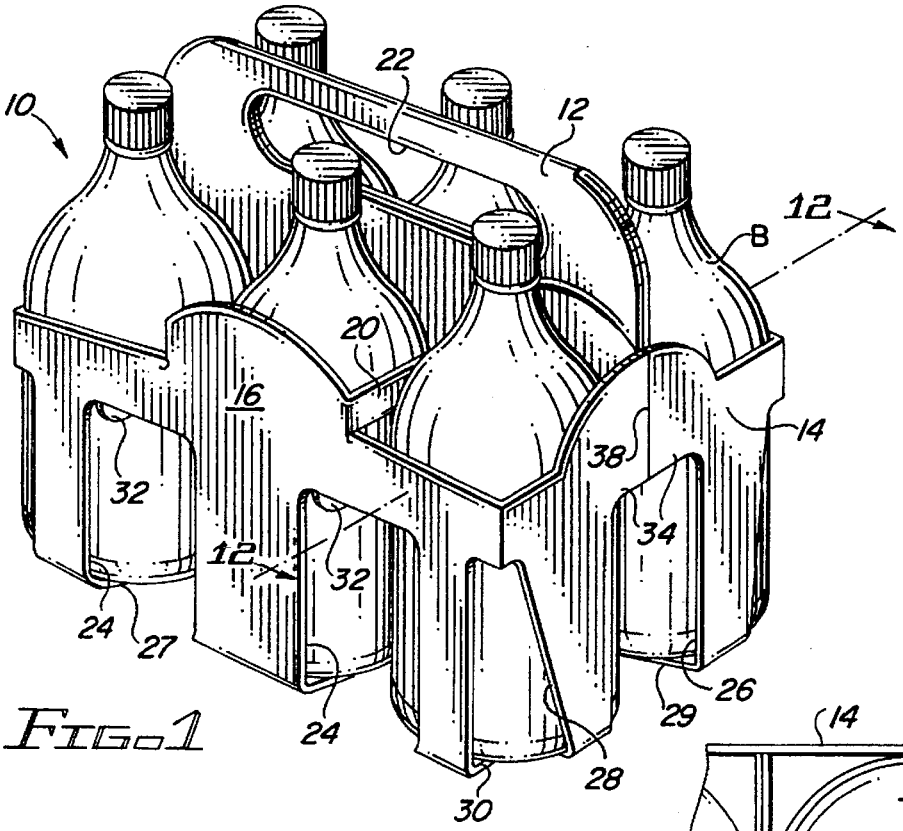
FIG. 1 is a pictorial view of the carrier of the invention, shown holding six beverage bottles.
Figure 2:
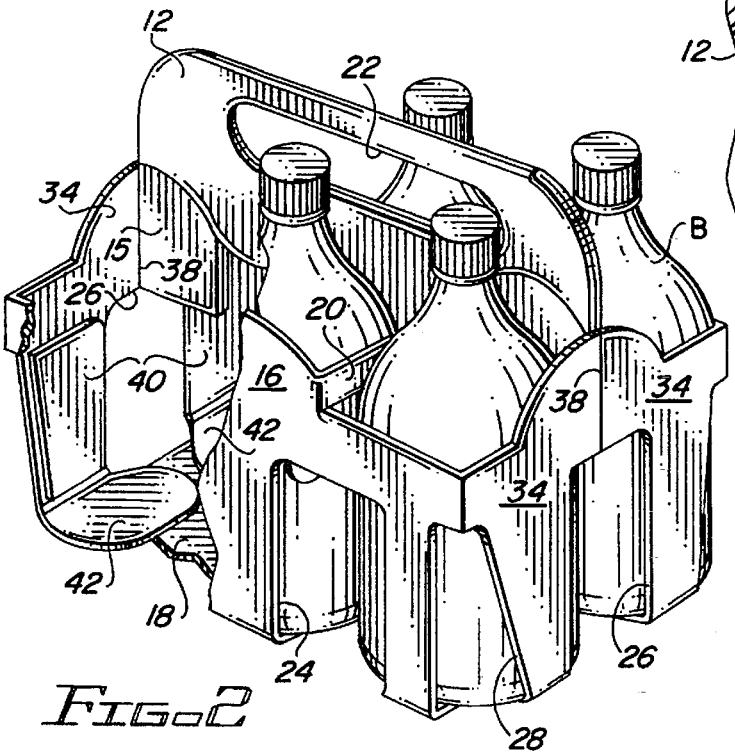
FIG. 2 is a pictorial view similar to that of FIG. 1, but with an end portion removed to show the interior of the carrier.

Referring to FIGS. 1 and 2, the basket-style carrier 10 of the invention includes a central handle panel 12 connected to end panels 14 through riser panels 15. The end panels 14 are connected to side panels 16, and the side panels are connected to bottom panel 18. Individual cells for receiving bottles B are formed by straps 20 which extend from the side panels 16 to the handle panel 12. A handle opening 22 is included in the handle panel. The carrier further includes two large open areas 24 in each side panel and a similar large open area 26 in each end panel. A narrower open area 28 is provided at each corner of the carrier. As illustrated, the bottom panel is also recessed at these open areas as indicated at 27, 29 and 30 to allow reinforcing struts or posts of a packing tray to extend slightly into the interior of a packed carrier. The open areas also act as windows to the interior of the carrier, exposing sufficient amounts of the lower portions of each bottle so that, together with the exposed upper bottle portions, a customer can readily appreciate the overall shape of the bottles regardless of the angle of view. This can be a significant commercial feature when the shape of the bottle is associated with the source of the product and is thus part of the process of brand recognition. Small portions of price code blocking flaps or doors 32 can be seen at the upper portion of the open areas 24, the details of which are explained below. Each end panel 14 is formed from end panel sections 34, the upper portions of which are connected by adjacent fold lines 38 to the adjacent riser panel.

It will be noted that the portions of the end panels between the cutouts 26 and 28 are basically narrow strips which have less ability than an end panel of full width to withstand the shock caused by the carrier being dropped into place in a packing tray. As shown in FIG. 2, these strips are strengthened by reinforcing flaps 40 which are foldably connected to the vertical edges of the end opening 26. The corner areas of the bottom panel are also strengthened by reinforcement flaps 42 which are foldably connected to the end panel strips.

Figure 3:
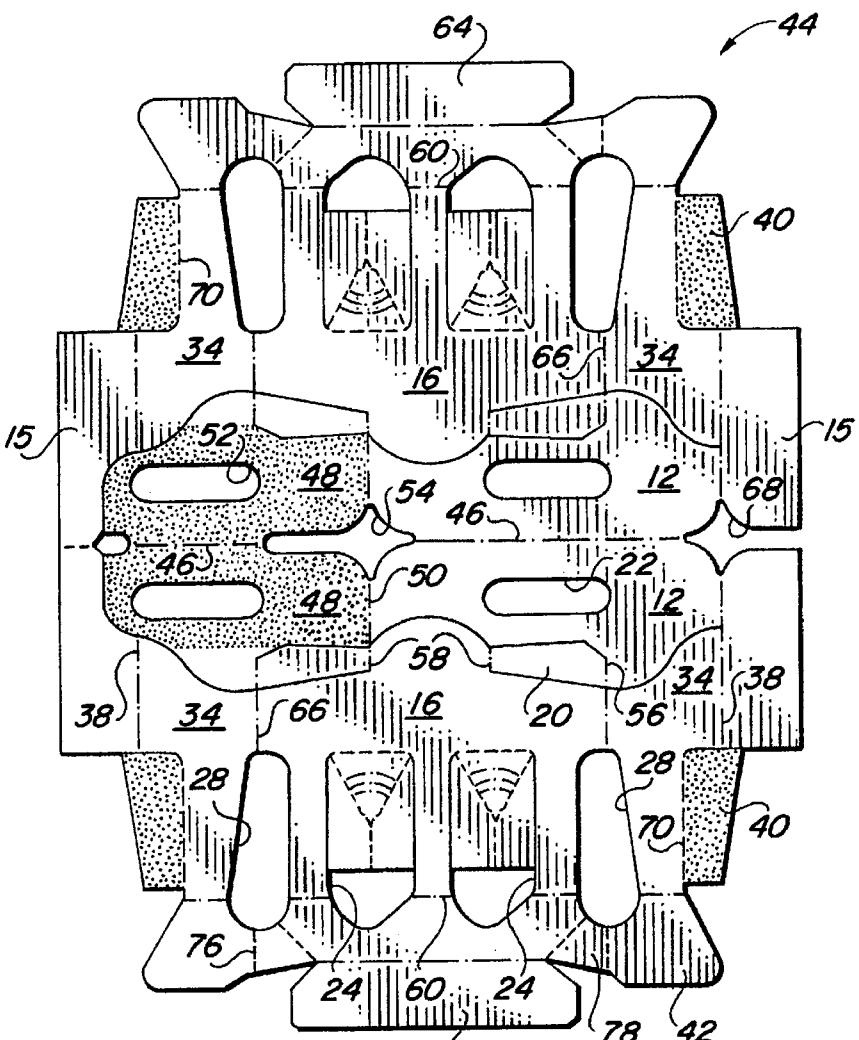
FIG. 3 is a plan view of a blank for forming the carrier of FIG. 1.

Referring to FIG. 3, wherein like reference numerals to those used in FIG. 1 denote like elements, a blank 44 for forming the carrier is shown as being of symmetrical, generally rectangular shape, comprised of two substantially identical halves connected by central fold line 46. Preferably, the blank is formed from paperboard of the type conventionally used in the carrier industry. Centrally located at the right side of the blank are two similar outer handle panel sections 12 connected together by the central fold line 46. Immediately to the left of the panel sections 12 are two similar inner handle panel sections 48, which are connected to each other by a continuation of central fold line 46 and which are further connected to the outer handle panel sections 12 by fold line 50. Cutouts 52 in the inner handle panel sections are aligned with the handle cutouts 22 in a carrier formed from the blank. Cutout 54 between the inner and outer handle panel sections facilitates folding about the central fold line 46 and determines the shape of the upper corner of one end of the handle panel.

The outer ends of the straps 20 are connected to the outer handle panel sections 12 by fold lines 56 while the inner ends of the straps are connected to the side panel sections 16 by fold lines 58. One of the side panel sections 16 is connected along fold line 60 to inner bottom panel flap 62 and the other side panel section 16 is connected along fold line 60 to outer bottom panel flap 64. The side panel sections 16 are connected by fold lines 66 to end panel sections 34, which in turn are connected along fold lines 38 to riser panel flaps 15. A cutout 68 at the right side of the blank separates the riser panel flaps 15 and also determines the shape of the upper corner of the other end of the handle panel. Other than the edges of the handle panel sections formed by the cutouts 54 and 68 and by fold lines 46, 50, and 38, the edges of the handle panel sections are formed by slits separating the handle panel sections from the cell divider straps and from the side and end panel sections, producing free edges when the blank is formed into a carrier.

Figure 4:
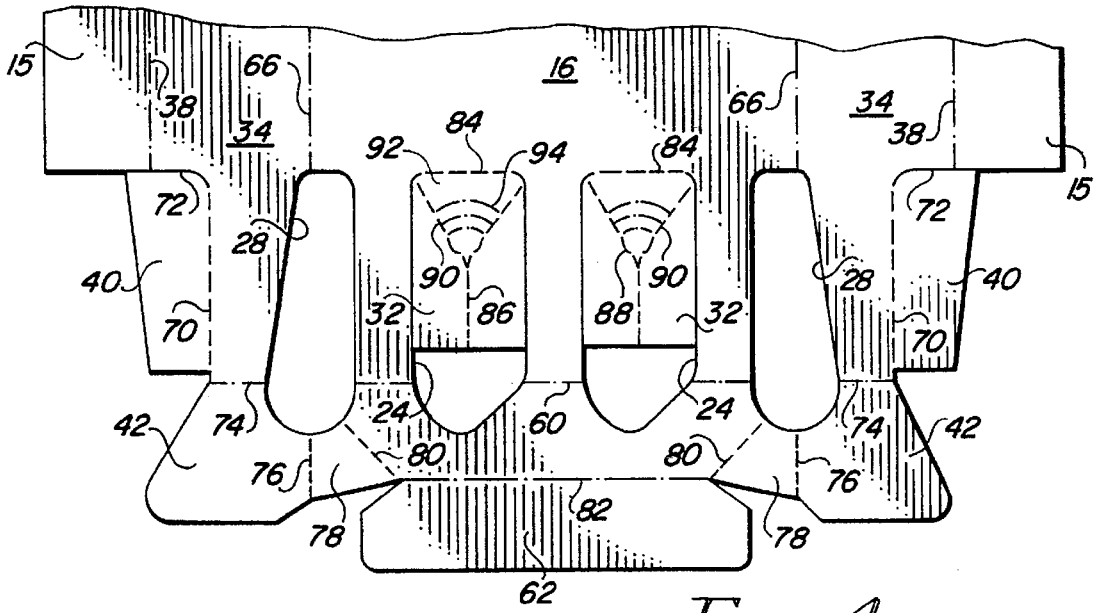
FIG. 4 is an enlarged plan view of a portion of the blank.

As best seen in FIG. 4, which shows an enlarged portion of the blank, each side panel section 16 includes two spaced cutouts 24 which extend into the adjacent bottom panel flap. Another narrower cutout 28 interrupts each corner fold line 66 so as to partially extend into the adjacent side panel section 16, the adjacent end panel section 34 and the adjacent bottom panel section 62 or 64. 25. Connected by fold line 70 to the opposite edge of the strip portion of the each panel section 34 is the reinforcement flap 40, which extends up to the edge of the adjacent riser panel flap 15. A slit 72 aligned with the adjacent riser panel edge and extending to the fold line 70 defines a free end of the reinforcement flap 40.

The bottom panel reinforcement flaps 42 are connected to the end panel sections 34 by fold lines 74, which are continuations of fold line 60. Each flap 42 is also connected by fold line 76 to gusset panel 78, which in turn is connected by diagonal fold line 80 to the bottom panel flap 62. The fold lines 76 are continuations of the fold lines 66 and are interrupted by the cutouts 28, while the fold line 80 extends from the cutout 28 to the intersection of the gusset panel free edge and fold line 82. Fold line 88 extends the length of the bottom panel flaps, essentially dividing the flaps in two.

Referring in particular to FIG. 4, the flaps 32 are connected to the side panel sections 16 along the upper edge of the cutouts 24 by fold line 84. Each flap includes a fold line 86 which bisects a portion of the flap, extending from the free edge of the flap to a slit 88. Fold lines 90 diverge from the slit 88 to the corners of the flap to form a generally triangular section 92. Arcuate score lines 94 in the section 92 extend between the diagonal fold lines 90.

Figure 5:
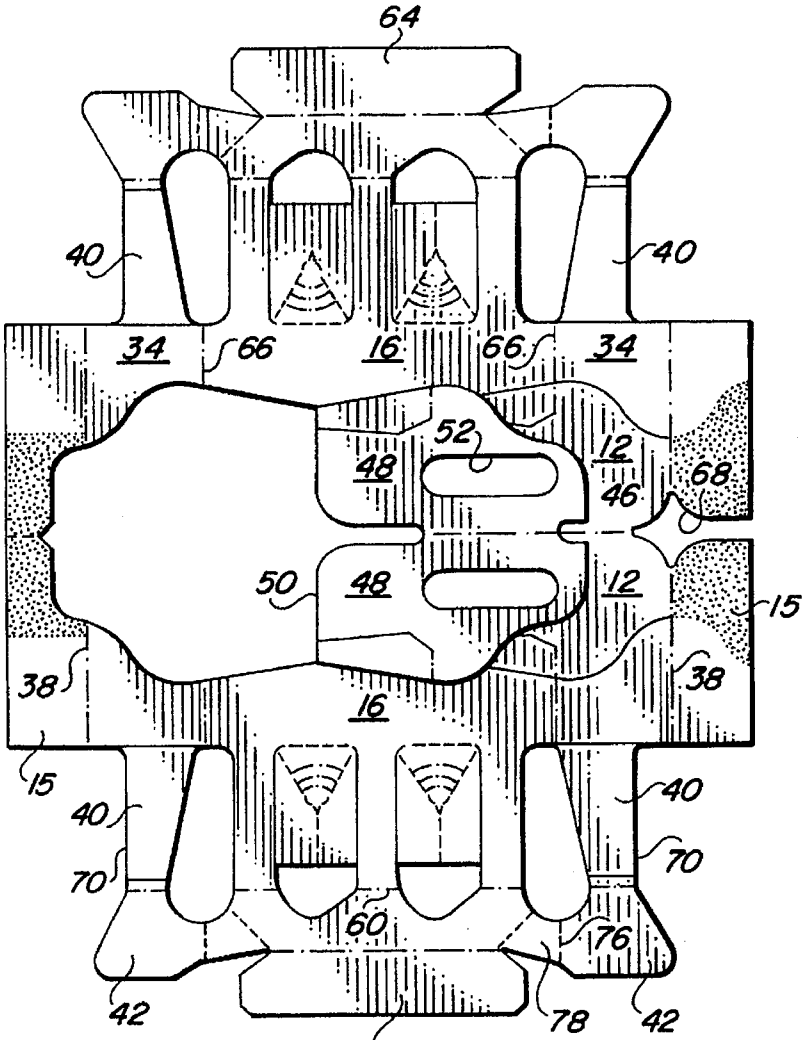
FIG. 5 is a plan view of the blank after an initial folding and gluing step.

Referring back to FIG. 3, to form a carrier from the blank the inner handle panel sections 48 and the reinforcement flaps 40 are coated with adhesive, as shown in stipple, and are then pivoted about their fold lines 50 and 70, respectively. The inner handle panel sections are thus adhered to the outer handle panel sections 12 and the reinforcement flaps are adhered to the adjacent strip portions of the end panel sections 34, as shown in FIG. 5. The next step is to apply adhesive to the riser panel flaps 15 in the areas shown in stipple in FIG. 5, then fold the riser panel flaps at the right of the blank about the fold lines 38 and the end panel sections 34 at the left of the blank about the fold lines 66. These steps adhere the riser panel flaps 15 to the handle panel sections 48 and 12 to produce the interim form of blank shown in FIG. 6.

Figure 6:
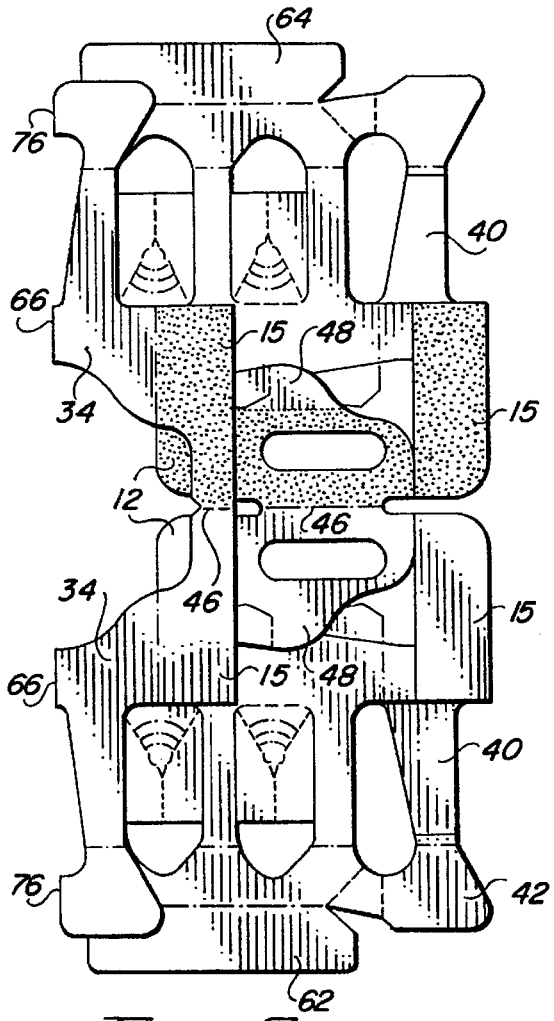
FIG. 6 is a plan view of the blank after a further folding and gluing step.

The final sequence of the forming operation is to apply adhesive to the stippled areas of the folded riser panel flaps 15 and to the stippled areas of the inner handle panel section 48, as shown in FIG. 6, and then fold the blank about the central fold line 46. This produces the collapsed carrier shown in FIG. 7, in which one of the end panels extends out from the side panels 16 in folded condition and the other end panel is inwardly folded between the side panels. The bottom reinforcement flaps 42, the gusset panels 78 and the bottom panel flaps 62 and 64 are still in unfolded condition at this point.

Figure 7:
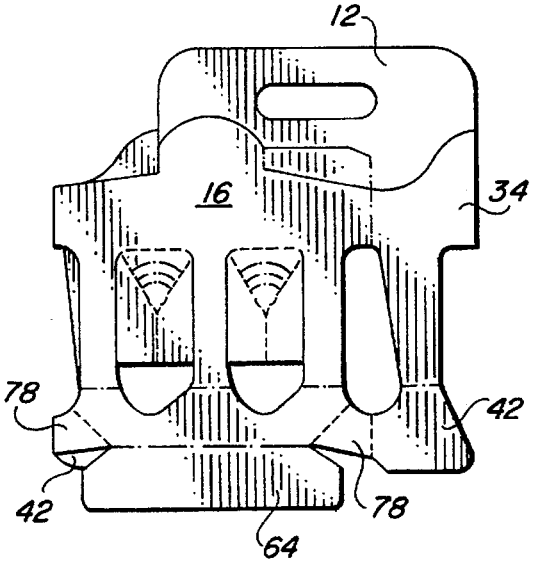
FIG. 7 is a plan view of a collapsed carrier after a final folding and gluing step.
Figure 8:
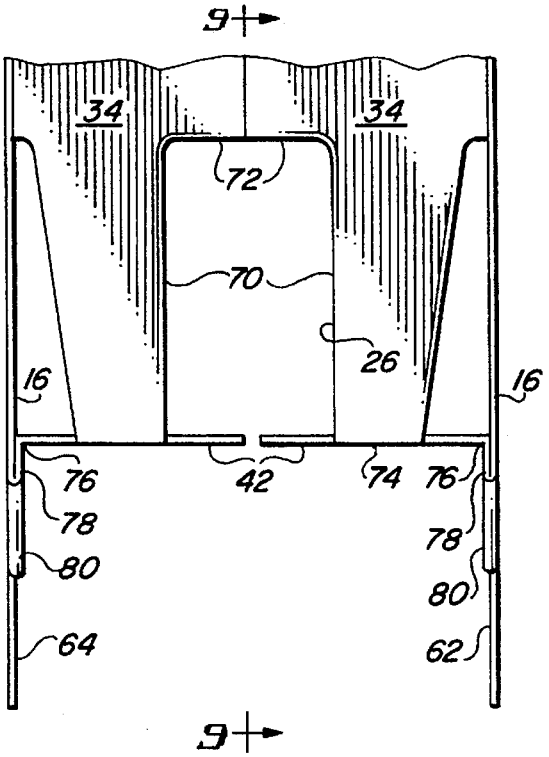
FIG. 8 is a partial end view of an erected carrier at 5 an interim stage of carrier formation.
Figure 9:
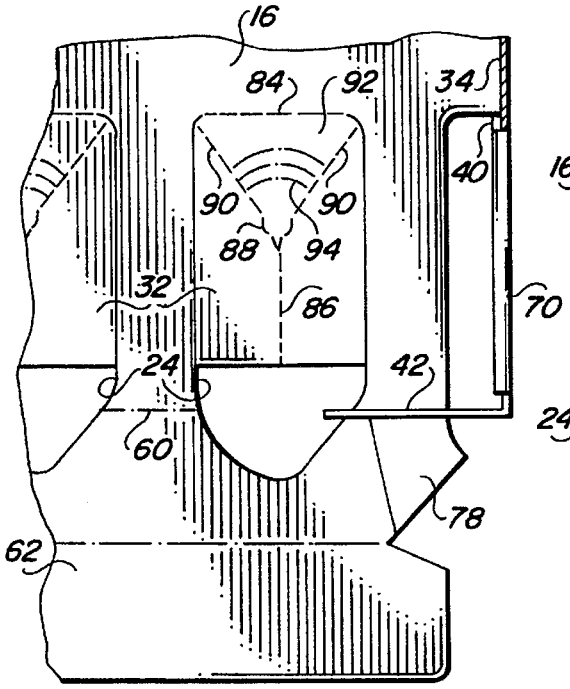
FIG. 9 is a partial longitudinal sectional view taken on line 9—9 of FIG. 8.

To form a loaded carrier from the collapsed carrier of FIG. 7, the collapsed carrier is squared up by pressing the outer ends of the outwardly extending end panel sections toward the opposite end, as is well known in the industry. The opened carrier is then aligned with a group of bottles to be packaged and lowered down over them. Of course the carrier could be opened as described and the bottles instead moved into the carrier. In either case, the gusset panels 78 are then folded up against the bottom panel flaps 62 and 64 about the fold lines 80, which causes the reinforcement flaps 42 to fold up to the horizontal about the fold lines 74. In doing so, the gusset panels 78 and the reinforcement flaps 40 are folded in the opposite direction about their connecting fold lines 76. The carrier at this stage of formation, with the bottles omitted for the purpose of clarity, is illustrated in FIGS. 8 and 9.

Figure 10:
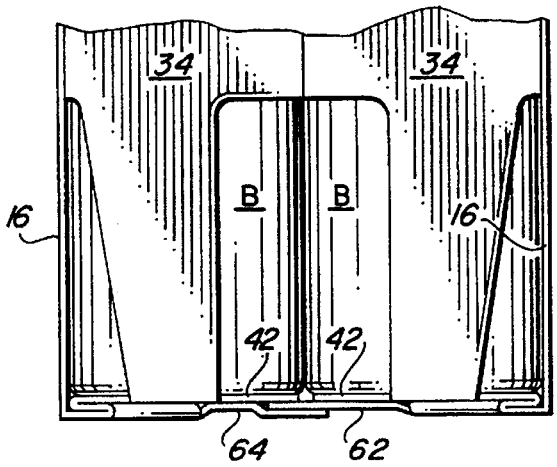
FIG. 10 is a partial end view of a finished carrier, containing beverage bottles.

The bottom panel flaps are then glued and folded into place, with the outer bottom panel flap 64 partially overlapping the inner bottom panel flap 62, as shown in FIG. 10. By means of this structure, the critical corner areas of the carrier are comprised of three plies of paperboard, with the gusset panels and reinforcement panels locked in place by the weight of the bottles resting on the reinforcement flaps. The gusset panels could also be glued to the reinforcement panels for more positive adherence if desired. It will be understood that although the bottom panel flaps have been shown in FIGS. 8 and 9 as still being unfolded and lying in the same plane as the side panels, they may be folded inwardly toward each other at the same time as the gusset panels are folded into place in order to make the gusset panels and the reinforcement panels more readily fold into place.

Figure 11:
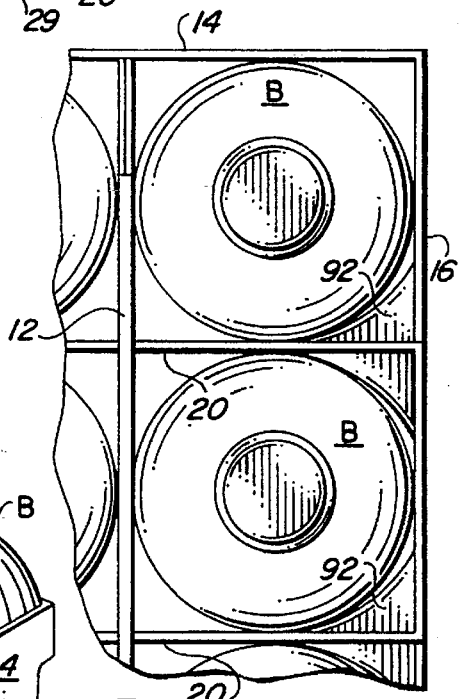
FIG. 11 is a partial plan view of a basket carrier, showing the side cutout flaps in their folded condition.
Figure 12:
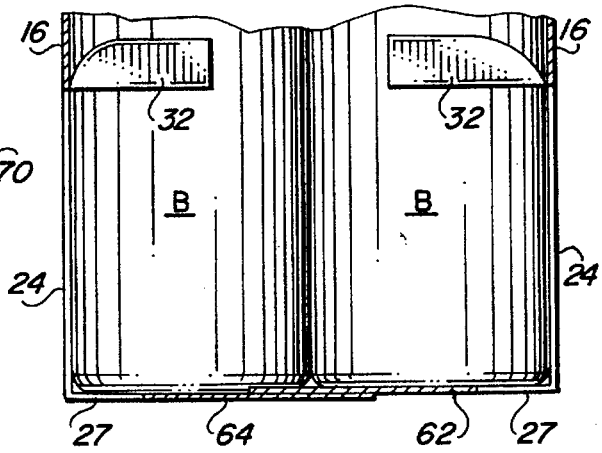
FIG. 12 is a transverse sectional view taken on line 12—12 of FIG. 1.

At some point in the carrier forming process prior to the carriers exiting from the packaging machine, the side panel opening flaps 34 are punched in and up about their fold lines 84. This causes the triangular section of the flaps to move into the interior of the carrier between adjacent bottles and the flaps to fold about their central fold lines 86. As the triangular section 92 of a flap 32 is pivoted up the sections of the flap on either side of the central fold line 86 fold toward each other and contact the adjacent bottles. This allows the bottom portions of the bottles adjacent the side panel openings 24 to readily be perceived, just as the end openings 26 permit the end bottles to be viewed. The view of the lower bottle portions is further enhanced by the portions of the bottles seen through the corner openings 28. The position of the triangular section 92 of the flaps 32 at this point is best illustrated in the top view of FIG. 11 and the sectional view of FIG. 12. The stresses caused by the angled connection of the flap sections to the triangular section and the bias of the flap sections against the adjacent bottles maintain the flaps in their final operative position. The slits 88 facilitate the folding operation, and the arcuate score lines 94 allow the triangular panel 92 to flex if necessary while preventing it from buckling. It can be appreciated that the presence of the triangular sections between the bottles relieves bottle-to-bottle contact and protects against possible breakage.

The side and end panel cutouts not only allow the lower portions of the bottles to be seen, but they also permit entry of packing tray support struts into the interior of the carrier to enable the carriers to be shipped in packing trays of molded plastic design. In addition, the folded side cutout flaps not only help to stabilize the bottles, but they also block the pricing bar code on the bottle labels, thus achieving another goal of the invention. It can be appreciated that the design of the carrier enables the end cutouts to be unobstructed by riser panels due to the use of short riser panels which terminate at the upper edge of the end cutouts. The flaps 40 produced from the end cutouts reinforce the narrow lower portions of the end panels, making the end panels resistant to the shock of being dropped into place in a packing tray.

Although the invention has been described in connection with a carrier designed to hold six beverage bottles, it will be understood that it also applies to carriers designed to hold other types of articles, or to carry fewer or greater numbers of articles. It is contemplated that the invention need not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A basket-style article carrier, comprising:

opposite side panels connected to a bottom panel;

a handle panel located between the side panels;

opposite end panels connected to the side panels, each end panel being comprised of two adjacent end panel sections;

a bottom panel comprised of two interconnected bottom panel flaps, each flap being connected by fold line to one of the side panels;

a bottom panel reinforcing flap connected by fold line to each of the end panel sections;

a gusset panel connected by fold line to each of the bottom panel reinforcing flaps, each gusset panel also being connected by fold line to an associated bottom panel flap, each gusset panel lying between an associated bottom panel flap and an associated reinforcing flap.

2. A basket-style article carrier as defined in claim 1, wherein each side panel includes a cutout through which substantial portions of the interior of the carrier can be seen.

3. A basket-style article carrier as defined in claim 2, wherein the end panels include a cutout through which substantial portions of the interior of the carrier can be seen.

4. A basket-style article carrier as defined in claim 3, wherein the bottom panel includes a plurality of cutouts, each bottom panel cutout being associated with and opening into one of the cutouts in the side and end panels.

5. A basket-style article carrier as defined in claim 2, wherein each side panel cutout has an upper edge to which a flap is connected by a fold line, the side panel cutout flap having a triangular section adjacent said fold line, the flap being folded up into the interior of the carrier and the triangular section being adapted to fit between portions of adjacent curved articles packaged in the carrier.

6. A basket-style article carrier as defined in claim 1, wherein each end panel has an inner surface and includes a cutout having opposite side edges, each side edge of each of the end panel cutouts being connected by fold line to a separate end panel reinforcing flap, the end panel reinforcing flaps being adhered to the inner surface of the end panels.

7. A basket-style article carrier as defined in claim 6, wherein the carrier includes corner cutouts at each end of the end panels, the reinforcing flaps lying between the end panel cutouts and the corner cutouts.

8. A basket-style article carrier as defined in claim 7, wherein each side panel includes a cutout through which substantial portions of the interior of the carrier can be seen.

9. A basket-style article carrier, comprising:

opposite side panels connected to a bottom panel;

a handle panel located between the side panels;

opposite end panels connected to the side panels, each end panel being comprised of two adjacent end panel sections;

a bottom panel comprised of two connected bottom panel flaps, each flap being connected by fold line to one of the side panels;

each of the end panels having an inner surface and including a cutout through which substantial portions of the interior of the carrier can be seen;

each cutout having opposite side edges; and each side edge of each of the end panel cutouts being connected by fold line to a separate end panel reinforcing flap, the end panel reinforcing flaps being adhered to the inner surface of the end panels.

10. A basket-style article carrier as defined in claim 9, wherein the end panel cutouts include upper edges and wherein the handle panel is connected at opposite ends to riser panels, the riser panels terminating adjacent the upper edges of the end panel cutouts.

11. A blank for forming a basket-style carrier, comprising:

two side panel sections;

each side panel section connected by fold lines to outer and inner handle panel sections, to a bottom panel flap and to opposite end panel sections such that the blank can be formed into a basket-style carrier;

handle panel support flaps connected to each of the end panel sections, the handle panel support flaps having inner and outer ends;

an outer bottom panel flap connected by a fold line to one of the side panel sections, the outer bottom panel flap having opposite end edges;

an inner bottom panel flap connected by a fold line to the other side panel section, the inner bottom panel flap having opposite end edges;

each end edge of each of the bottom panel flaps being connected by a fold line to a separate gusset panel;

each gusset panel being connected by a fold line to a separate bottom panel reinforcing flap; and each bottom panel reinforcing flap being connected by a fold line to an associated end panel section.

12. A blank as defined in claim 11, wherein each end panel section includes a recess adapted to open into the recess in an associated end panel section in a carrier formed from the blank to create an end panel cutout in such a carrier.

13. A blank as defined in claim 12, wherein each recess has a side edge, an end panel reinforcing flap connected by fold line to the side edge of each recess, the end panel reinforcing flaps being adapted to be folded against the associated end panel section to reinforce the end panels of a carrier formed from the blank.

14. A blank as defined in claim 11, wherein each side panel section includes a cutout through which substantial portions of the interior of carrier formed from the blank can be seen.

15. A blank as defined in claim 14, wherein each side panel cutout has an upper edge to which a flap is connected by a fold line, the side panel cutout flap having a triangular section adjacent said fold line, the triangular section being adapted to fit between portions of adjacent curved articles packaged in a carrier formed from the blank when the flap is folded up into the interior of such a carrier.

* * * * *